United States Patent [19]

Surakka et al.

[11] 4,148,722

[45] Apr. 10, 1979

[54] MULTIPLE HYDROCYCLONE ARRANGEMENT

[75] Inventors: Jorma Surakka; Matti Lankinen, both of Savonlinna, Finland

[73] Assignee: Enso-Gutzeit Osakeyhtio, Helsinki, Finland

[21] Appl. No.: 845,663

[22] Filed: Oct. 26, 1977

[30] Foreign Application Priority Data

Nov. 1, 1976 [FI] Finland ..... 763102

[51] Int. Cl.[2] ..... B04C 5/28

[52] U.S. Cl. ..... 209/211; 210/512 M

[58] Field of Search ..... 209/211, 144; 210/512 R, 512 M; 55/346, 349

[56] References Cited

U.S. PATENT DOCUMENTS

| | | | |
|---|---|---|---|
| 3,598,731 | 8/1971 | Frykhult et al. | 210/512 M X |
| 3,731,800 | 8/1973 | Timson | 209/144 X |
| 3,959,123 | 5/1976 | Wikdahl | 209/211 |
| 4,019,980 | 4/1977 | Beery | 209/211 |

FOREIGN PATENT DOCUMENTS

| | | | |
|---|---|---|---|
| 510269 | 6/1976 | U.S.S.R. | 209/211 |

*Primary Examiner*—Ralph J. Hill

*Attorney, Agent, or Firm*—Toren, McGeady and Stanger

[57] ABSTRACT

A hydrocyclone assembly consisting of two identical hydrocyclones having accept tubes directed against each other so that the longitudinal axes of the hydrocyclones are aligned, and including a joint feed chamber and a joint accept chamber in which the combined accept fraction from the hydrocyclones accumulates. The accept ends of the hydrocyclones' accept tubes are connected with each other and the accept fractions are conducted into and combined in connecting ducts which communicate with the accept chamber.

2 Claims, 6 Drawing Figures

MULTIPLE HYDROCYCLONE ARRANGEMENT

Hydrocyclones or vortex purifiers normally comprise a conical tube into which the fluid to be purified, such as e.g. an approximately 1% pulp stock suspension, is tangentially introduced and wherein the purifying effect is based on centrifugul force. In principle, the hydrocyclone consists of a conical sorter tube and an accept tube located at the wider end hereof.

In cellulose and paper mills, for purifying the fibre suspension, hydrocyclone installations are used which may comprise up to 500 individual hydrocyclones connected in parallel. Installations of this kind are often constructed so that the hydrocyclones are either totally or partly mounted within tanks having their own feed, accept and reject chambers, with which the individual hydrocyclones communicate directly by apertures provided in them. It is understood that in this case no separate connectors are needed for feed, accept and reject fractions, whereby the apparatus will be less expensive.

This apparatus of the prior art is characterized in that the walls of the tanks must have apertures through which the hydrocyclones are installed. Since the feed, accept and reject fractions have to be separated, these apertures must be sealed. The apertures must furthermore be located exactly on the axis of the hydrocyclone so that installation of the hydrocyclone might be rapidly accomplished. Owing to the facts mentioned, hydrocyclone set-ups of prior art command a comparatively high price and difficulties are encountered in their manufacturing.

The object of the present invention is to provide a hydrocyclone means by the aid of which the detriments mentioned may be substantially reduced. The hydrocyclone means of the invention is characterized in that the accept ends of the hydrocyclones' accept tubes have been connected with each other and that the accepts have been conducted into connected ducts, where the accepts are combined and which communicate with the accept chamber. The hydrocyclone means of the invention affords a considerable floor space economy.

Figure 1:
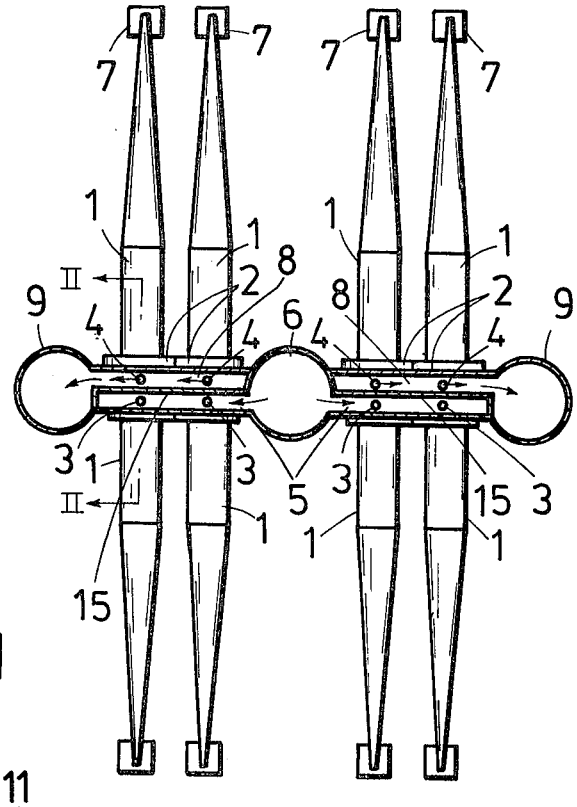
Figure 2:
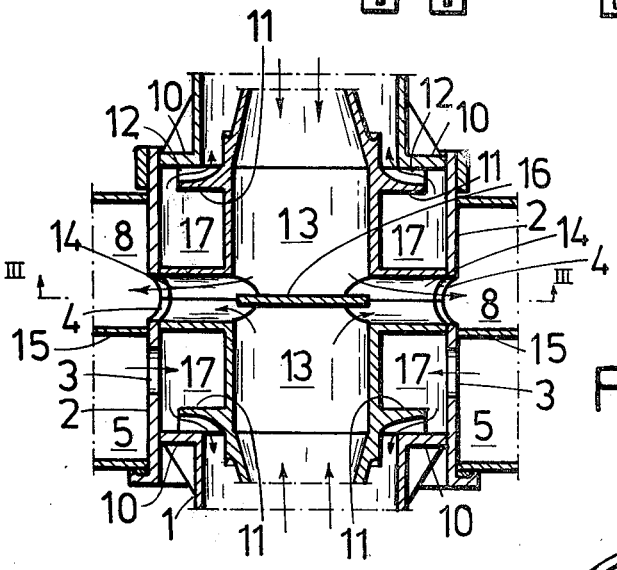
Figure 3:
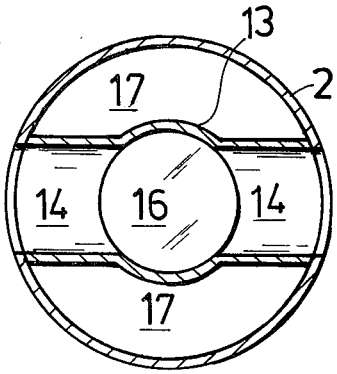
Figure 4:
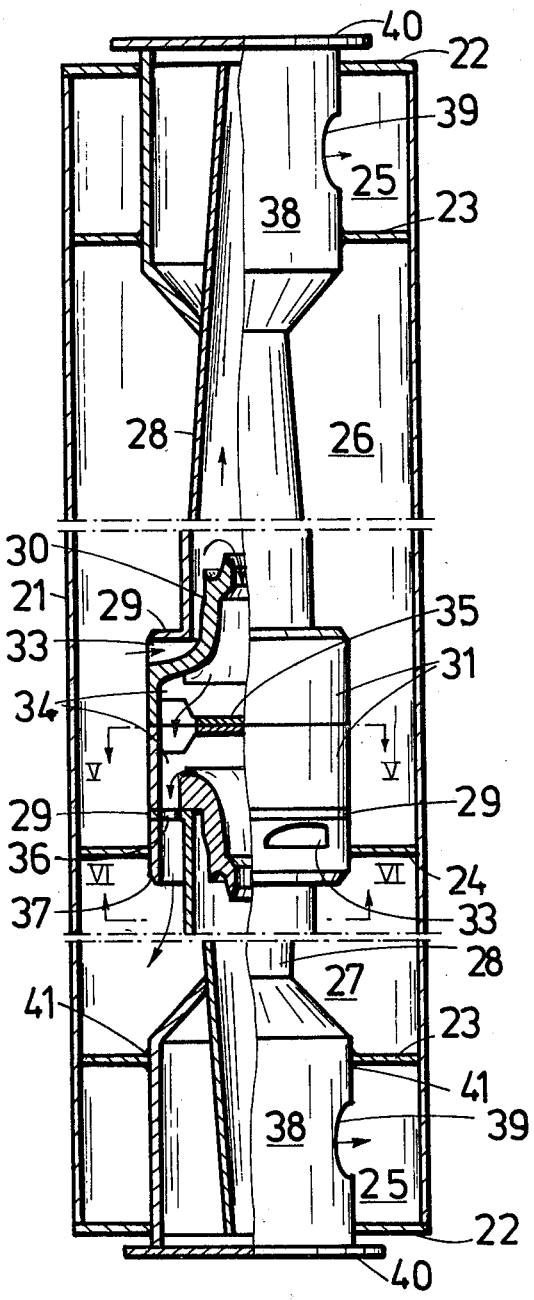
Figure 5:
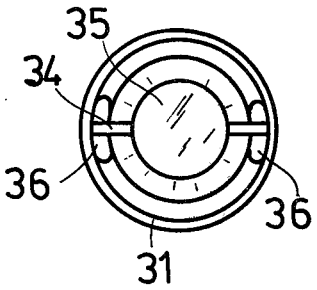
Figure 6:
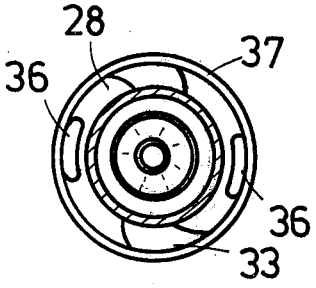

In the following a few advantageous embodiments of the invention are described by the aid of drawings, wherein FIG. 1 presents, in top view and in section, a hydrocyclone installation with several layers of hydrocyclone means according to the invention, the section having been carried between two such layers, FIG. 2 presents the section along the line II—II in FIG. 1, showing the juncture of the hydrocyclones' accept ends, FIG. 3 shows the section along the line III—III in FIG. 2 at the junction of the accept ends, FIG. 4 shows, in top view, a hydrocyclone installation with a plurality of hydrocyclone means according to another embodiment of the invention enclosed in a tank, FIG. 5 shows the section along the line V—V in FIG. 4 at the juncture of the hydrocyclones' accept ends, and FIG. 6 shows the section along the line VI—VI in FIG. 4.

The hydrocyclone installation of FIG. 1 consists of individual hydrocyclones 1 placed in several layers and connected, two and two, by their accept ends so that the longitudinal axes of the hydrocyclones are aligned, whereby double hydrocyclones are formed. The accept end of each double hydrocyclone is encircled by a cylindrical jacket 2, which has been provided with holes 3 and 4. The holes 3 open into the feed duct 5 of the hydrocyclones, which is common to all hydrocyclones connected in parallel and into which the fibre suspension to be purified is conducted from one common feed tube 6, which in the case shown in FIG. 1 is vertical, when the hydrocyclones have been horizontally mounted. The feed ducts 5 are located in the height dimension of the feed tube 6 between each two hydrocyclone layers, so that each individual hydrocyclone 1 is supplied from two opposite sides (FIG. 2).

From the fibre suspension supplied into the hydrocyclones through the holes 3 the reject fractions are separated in a normal manner and they are eliminated into common reject tubes 7, in which the tips of the hydrocyclones have been countersunk so that no air can be drawn into the hydrocyclones through the reject apertures. The accept fraction separated from the fibre suspension, again, is removed from each hydrocyclone through the hole 4 into the accept chambers 8, which conduct the accept fractions, as shown in FIG. 1, to the larger accept collecting tubes 9 on the sides of the hydrocyclone installation.

In FIG. 2 the construction and operation of the hydrocyclones' accept sections have been presented in detail. The hydrocyclones 1 mounted with their accept ends against each other have been attached by their flanges 10 on the inner surface of the cylinder jacket 2. The hydrocyclones are preferably of the type disclosed in U.S. Pat. No. 4,067,814, whereby the hydrocyclone has on its accept end a cover 11 in which the feed ducts 12 for introduction of fibre suspension into the hydrocyclone are located. The accept tubes 13 have been placed with their ends against each other. At the juncture of the accept tubes 13 radial elliptic tubes 14 have been connected with their jackets and which connect the interiors of the accept tubes 13 with the accept ducts 8, which have been separated from the feed ducts 5 by partitions 15. At the level of the centre-line of the tubes 14, a round disk 16 has been affixed to the inner jacket of the accept tube 13, as shown in FIG. 3.

When the feed material is fed from the feed ducts 5 through the cylinder jacket 2 by the holes 3, the annular space, or feed chamber, 17 between the accept tubes 13 and the cylinder jacket 2 is filled, and the feed is distributed into both hydrocyclones 1 through the feed ducts 12. In the hydrocyclones 1 the feed is divided in a conventional manner into reject fractions and accept fractions, the latter entering the accept tubes 13. The task of the circular plate 16 is to prevent the collision of the accept fractions and to divide the accept fractions from both hydrocyclones into the removal tubes 14, whence the accept fractions have access through the gaps between the outer edges of the circular plate 16 and the mouth apertures of the tubes 14 (FIG. 2). From the tubes 14, the accept fractions discharge through the apertures 4 in the cylindrical jacket 2 into the accept ducts 8, which are divided from the feed ducts 5 by partitions 15. From the accept ducts 8, which are closed at their end adjacent to the feed tube 6 (FIG. 1), the accept fractions are collected into collect tubes 9 on the outside of the hydrocyclones.

In FIG. 4 a hydrocyclone installation according to the invention has been accommodated in a tank which is divided by its side walls 21 and ends 22 and by partitions 23 and 24 into separate chambers 25, 26 and 27. The hydrocyclone apparatus consists, in accordance with the preceding embodiment, of two identical hydrocyclones which have been mounted with their accept ends against each other.

The hydrocyclone has a conical sorter tube 28 with the accept tube 30 affixed at its wider end to the flange 29 found there. The accept tube 30 consists of a mainly cylindrical part entering the sorter tube 28 and preferably of the kind disclosed in U.S. patent application Ser. No. 793,860.

The accept tube 30 has a wider cylindrical part 31, which contains tangential feed ducts 33 of the kind disclosed in U.S. Pat. No. 4,067,814, and which start from the chamber 26. To plates 34 affixed to the inner surface of each hydrocyclone's accept tube 30, circular plates 35 have been attached (FIG. 5), which oppose each other and the plane of which is perpendicular to the longitudinal axis of the hydrocyclones.

The flange 29 of the lower hydrocyclone in FIG. 4 has been provided with bores 36 (FIG. 6). To the flange 29 and to the partition 24 the cylindrical part 37 has been affixed, which has the same diameter as the cylindrical part 31 of the accept tube 30 and the lower margin of which extends into the chamber 27, so that the interiors of the hydrocyclones' accept tubes 30 communicate through the bores 36 with the chamber 27.

The conical sorter tubes 28 of the hydrocyclones have been enclosed at their reject ends in substantially cylindrical tanks 38, in the jackets of which holes 39 have been made through which the reject fractions discharge into the chambers 25. It is advantageous if the ends 40 of the tanks 38 are made transparent so that the operation of the reject fractions can be inspected. The ends 40 may furthermore be provided with valves through which e.g. a water jet may be introduced in order to clear the reject apertures if they are blocked.

The tanks 38 and the cylindrical parts 31 have equal diameter, whereby, if required, the hydrocyclone apparatus may be withdrawn from the tank and a replacement may be mounted therein. To this purpose, the cylindrical parts 38 and 31 have been sealed at the points where they pass through the walls 22, 23 and 24, with gaskets 41 made of rubber or another appropriate material.

In the hydrocyclone apparatus of FIG. 4, the fibre suspension to be purified is introduced into the feed chamber 26 in the central part of the tank, and which thus is common to both hydrocyclones. The fibre suspension is carried into the feed ducts 33, whence it discharges in the form of a helical jet in the manner described in U.S. Pat. No. 4,067,814 into the sorter tube 28, where the impurities are separated in normal manner to become reject fractions, which are removed through the holes 39 in the jackets of the reject tanks 38 into the reject chambers 25. The accept fraction separated in the sorter tubes 28 discharges in a vortex into the accept tubes 30, the circular plates 35 within these preventing collision of the accept fractions. When the vortices coming from the accept tubes 30 hit the vertical plates 34 serving as mountings for the circular plates 35, the turbulent motions following the inner circumference of the accept tubes 30 cease and the accept fraction flows quiet down, whereupon the accept fractions discharge through the gaps between the edges of the circular plates 35 and the cylindrical jackets, into the apertures 36, through which the accept fractions are removed into the accept chamber 27 common to both hydrocyclones.

The invention is not confined to the embodiments illustrated by the drawings, and it may be modified within the scope of the claims.

We claim:

1. A hydrocyclone assembly for the separation of a liquid suspension into accept fractions and reject fractions comprising: at least one pair of generally similar hydrocyclones each having a longitudinal axis and including accept ends, said pair of hydrocyclones being arranged in generally longitudinal alignment end-to-end with their accept ends adjacent each other, each of said hydrocyclones having a joint feed chamber and a joint accept chamber wherein the combined accept fractions from said pair of hydrocyclones accumulate; accept tubes in each of said hydrocyclones, said accept tubes having ends directed against each other; one of said accept tubes of said pair of hydrocyclones including an outer surface; the other of said accept tubes having an expanded cylindrical part with an inner surface concentric with said outer surface; an annular flange accommodated between said outer surface and said inner surface of said expanded cylindrical part; and means defining apertures located in said annular flange for conducting the accept fractions from said accept tubes into said accept chamber.

2. An assembly according to claim 1 including a plate affixed at the juncture of said accept tubes to said inner surface, said plate preventing collision of the accept fractions and defining a gap between the edges of the plate and said inner surface through which the accept fractions discharge into said connecting means.

* * * * *